US008205411B2

(12) United States Patent
Mellett

(10) Patent No.: US 8,205,411 B2
(45) Date of Patent: Jun. 26, 2012

(54) APPARATUS FOR SUPPORTING FORMWORK PANELS IN WALL CONSTRUCTION

(75) Inventor: Eoghan Mellett, Dublin (IE)

(73) Assignee: Off Site Construction R&D Limited, Dublin (IE)

( * ) Notice: Subject to any disclaimer, the term of this patent is extended or adjusted under 35 U.S.C. 154(b) by 464 days.

(21) Appl. No.: 12/366,157

(22) Filed: Feb. 5, 2009

(65) Prior Publication Data

US 2009/0193744 A1 Aug. 6, 2009

(30) Foreign Application Priority Data

Feb. 5, 2008 (IE) ..... S2008/0091
Sep. 18, 2008 (IE) ..... S2008/0752

(51) Int. Cl.
*E04B 1/00* (2006.01)

(52) U.S. Cl. ..... 52/742.14; 52/79.14; 52/127.2; 52/294; 249/33; 249/189

(58) Field of Classification Search ..... 249/33, 249/34, 39, 40, 188, 189, 219.1, 219.2; 52/241, 52/742.1, 742.13, 742.14, 292, 293.1, 293.3, 52/294, 415, 79.14, 79.9, 79.11, 426, 435, 52/479, 745.1, 750

See application file for complete search history.

(56) References Cited

U.S. PATENT DOCUMENTS

| | | | | |
|---|---|---|---|---|
| 2,378,850 | A * | 6/1945 | Hyre | 249/210 |
| 2,490,228 | A * | 12/1949 | Pontiere | 249/22 |
| 3,405,905 | A * | 10/1968 | Dakin | 249/40 |
| 3,778,020 | A * | 12/1973 | Burrows et al. | 249/219.1 |
| 5,937,604 | A * | 8/1999 | Bowron | 52/426 |
| 6,398,180 | B1 * | 6/2002 | Eyring et al. | 249/177 |
| 6,551,011 | B1 * | 4/2003 | Valentine | 404/6 |
| 6,883,772 | B2 * | 4/2005 | Takagi et al. | 249/139 |
| 2003/0115816 | A1 * | 6/2003 | Dodson et al. | 52/381 |

FOREIGN PATENT DOCUMENTS

WO 2004/091903 A1 10/2004

* cited by examiner

*Primary Examiner* — William Gilbert
(74) *Attorney, Agent, or Firm* — Christopher & Weisberg, P.A.

(57) ABSTRACT

An apparatus for supporting formwork panels in wall construction comprises a pair of rails for supporting the lower edges of a pair of formwork panels. Spacers fixed to the floor engage the rails to maintain them parallel to one another a predetermined distance apart.

9 Claims, 7 Drawing Sheets

APPARATUS FOR SUPPORTING FORMWORK PANELS IN WALL CONSTRUCTION

CROSS-REFERENCE TO RELATED APPLICATION

This application related to and claims priority to Irish Patent Application Serial Number S2008/0091, filed Feb. 5, 2008 and Irish Patent Application Serial Number S2008/0752, filed Sep. 18, 2008, the entirety of all which are incorporated herein by reference.

STATEMENT REGARDING FEDERALLY SPONSORED RESEARCH OR DEVELOPMENT n/a

FIELD OF INVENTION

The present invention relates to an apparatus for supporting formwork panels in wall construction, a method of constructing a wall using such apparatus, and a wall so constructed.

BACKGROUND OF THE INVENTION

A type of wall construction is known in which formwork panels are mounted vertically upright and parallel to one another on a solid concrete floor, and the gap between the two filled with concrete. When the concrete is set the formwork panels can be left in place to form an integral part of the wall. These panels are known as permanent formwork panels and are typically made of cement—see, for example, WO 2004/091903.

It is therefore desirable to provide an apparatus and method to facilitate the construction of such walls.

SUMMARY OF THE INVENTION

The present invention advantageously provides a method and system for supporting formwork panels in wall construction.

In accordance with one aspect, the present invention provides an apparatus for supporting formwork panels in wall construction in which at least one pair of rails each supports the lower edge of a respective formwork panel. At least one spacer engages the rails and maintaining them substantially parallel to one another a predetermined distance apart. A fixing means fixes the spacer to a solid floor.

In accordance with another aspect, the present invention provides a method of constructing a wall in which at least one pair of rails is laid on a solid floor with at least one spacer fixed to the floor engaging the rails and maintaining the rails substantially parallel to one another a predetermined distance apart. A pair of substantially parallel vertical formwork panels are located on the rails. Each panel is supported by its lower edge on a respective rail. The gap between the panels is filled.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

An embodiment of the invention will now be described, by way of example, with reference to the accompanying drawings, in which.

DETAILED DESCRIPTION OF THE INVENTION

Figure 1:
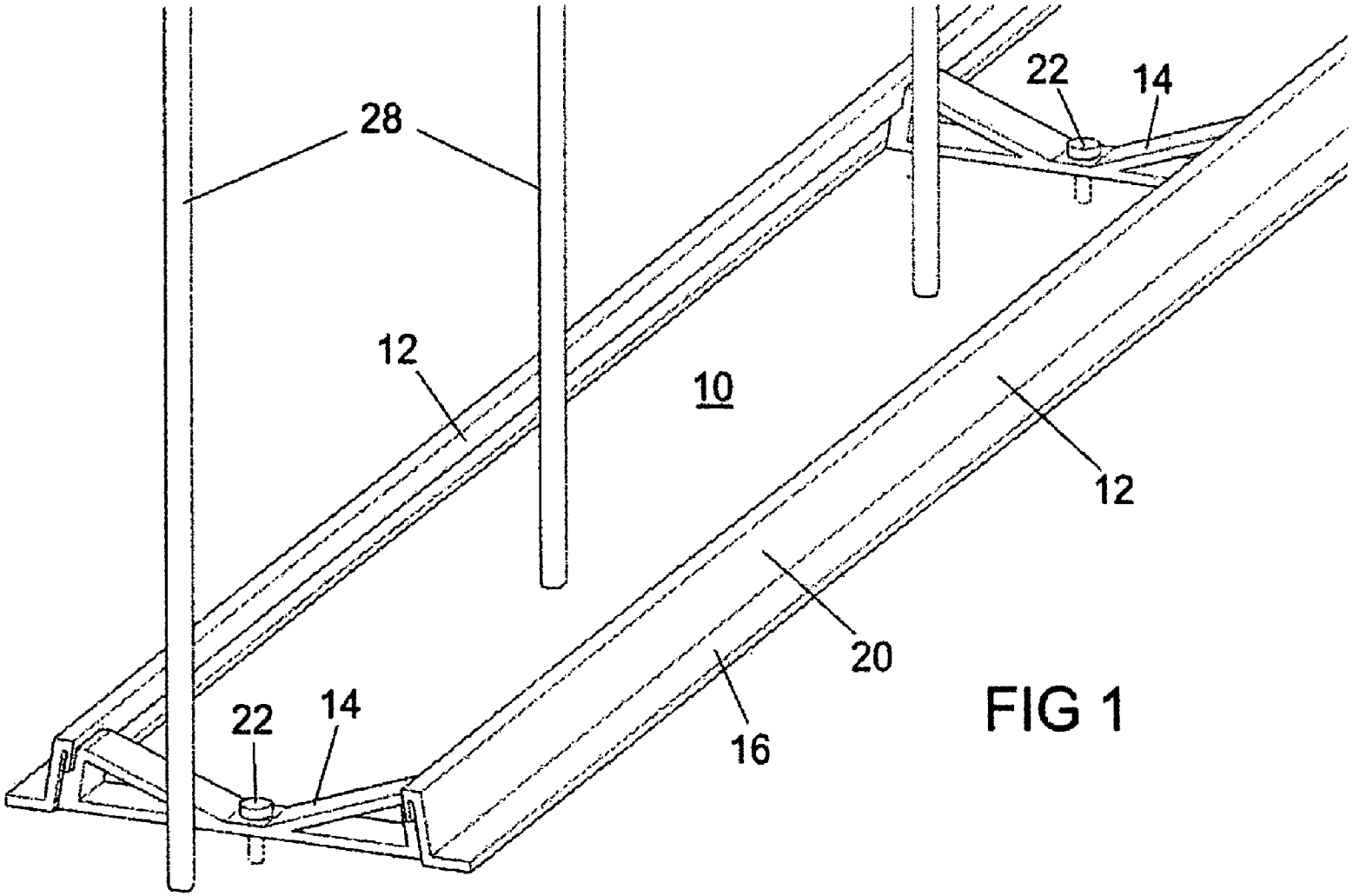
FIG. 1 is a perspective view of an apparatus according to a first embodiment of the invention, laid out on a solid concrete floor.

In the drawings the same reference numerals have been used for the same or equivalent components in the various embodiments.

Figure 2:
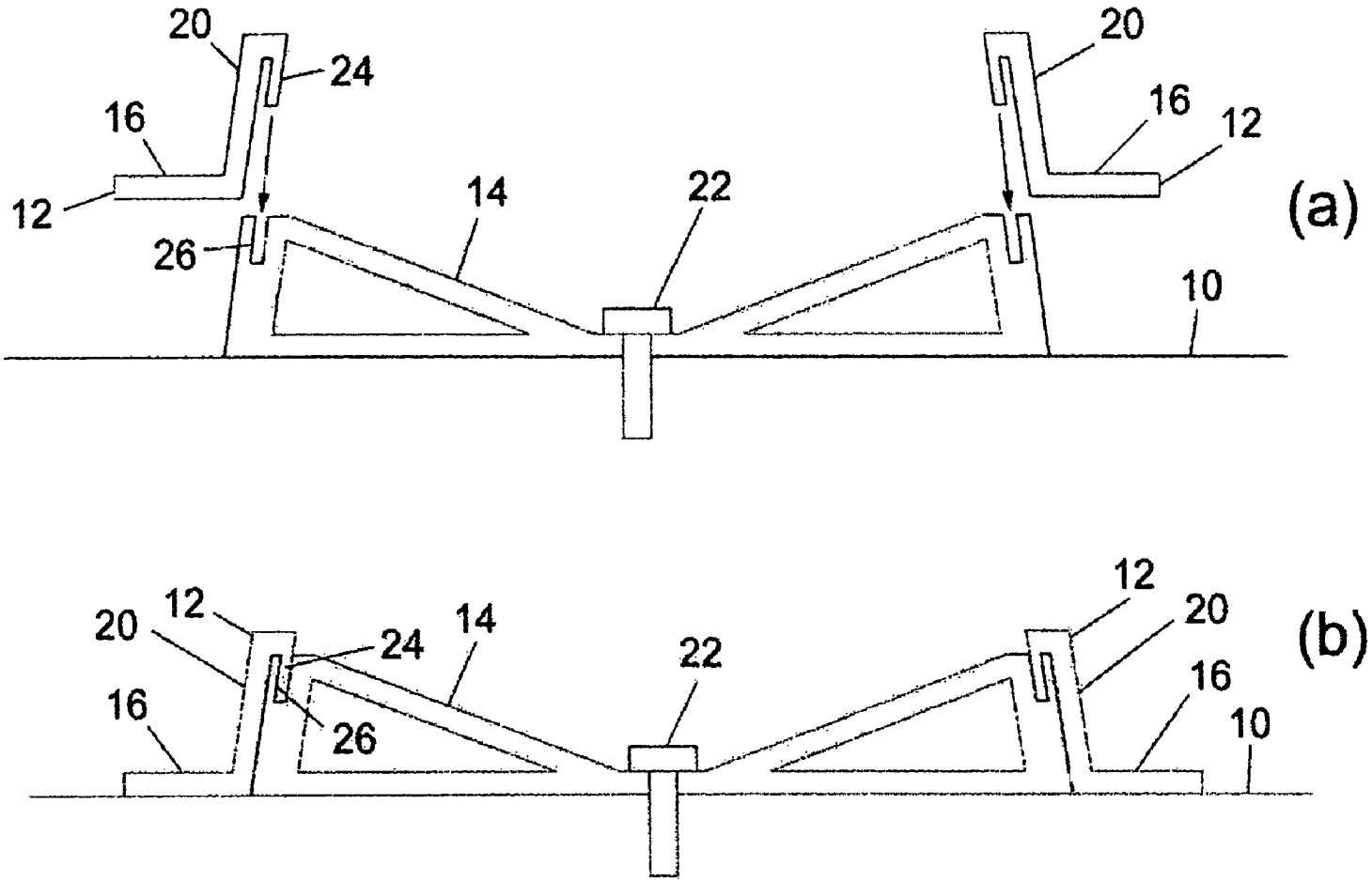
FIG. 2*a* is a cross-section of the apparatus of FIG. 1 prior to the engagement of the support rails with the spacer.
FIG. 2*b* is a cross-section of the apparatus of FIG. 1 after the engagement of the support rails with the spacer
Figure 3:
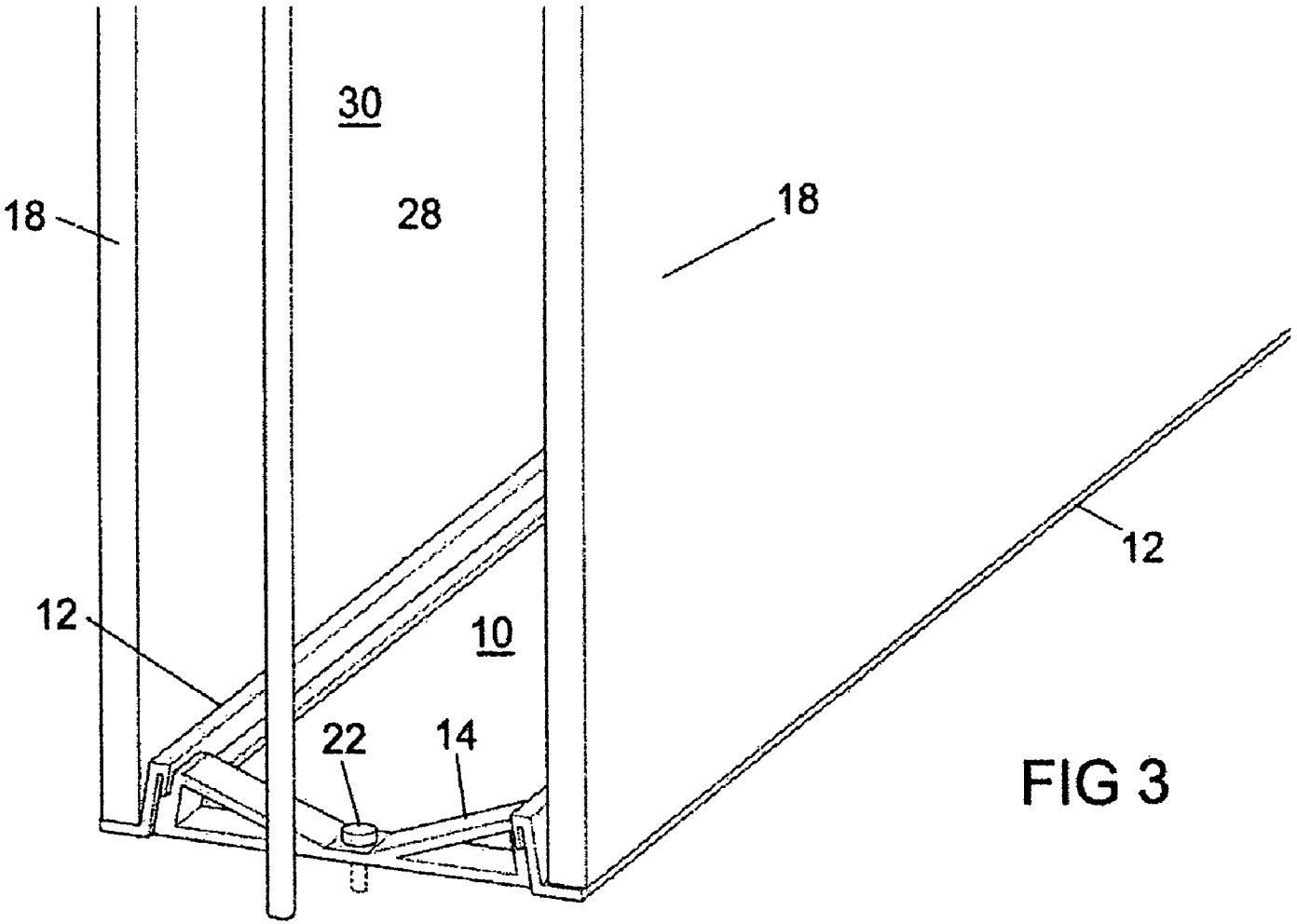
FIG. 3 is a perspective view of the apparatus of FIG. 1 with formwork panels supported on the rails.

Referring to FIGS. 1 to 3, a wall is constructed on a solid concrete floor 10 by laying a pair of panel support rails 12 parallel to one another on the floor. A plurality of identical transverse spacers 14 engage the rails 12 at spaced points along their length and maintain the rails 12 parallel to one another and a predetermined distance apart defined by the length of the spacers. Each rail 12 comprises a flat, highly elongated support plate 16 for supporting the lower edge of a respective formwork panel 18 (FIG. 3), an inwardly inclined wall 20 extending upwardly from the inside longitudinal edge of the support plate (in the present context "inwardly" means towards the longitudinal centerline between the two rails), and a flange 24 which extends downwardly from the top of the inclined wall 20 on the opposite side to the support plate 16. The rails 12 have a substantially constant cross-section and are made by extrusion of a plastics material, such as poly vinyl chloride, polypropylene or high density polyethylene.

The spacers 14 are fixed to the floor 10 by bolts or HILTI gun nails 22, and the rails 12 engage and are held in place at opposite outer ends respectively of the spacers 14 by inserting the flanges 24 into respective upwardly opening slots 26 in the ends of the spacers (FIG. 2), the flanges 24 fitting snugly into the slots 26. Since the slots 26 run the entire length of the rails 12, the spacers 14 can, prior to fixing, be slid along the rails for positioning at any desired point. In particular, they can be positioned to avoid wall reinforcing bars 28 extending upwardly from the solid floor 10.

When the rails 12 and spacers 14 are fixed in position on the solid floor 10, a pair of permanent formwork panels 18 is lowered onto the rails 12 so that the lower edge of each panel rests on a respective elongated support plate 16, FIG. 3. The panels 18 are substantially parallel to one another and spaced apart by substantially the same distance as the distance between the inside longitudinal edges of the support plates 16. They are held together by suitable ties (not shown), and when resting on the rails 12 extend vertically upwards. The inclined walls 20 assist in accurate location of the lower edges of the panels 18.

Figure 4:
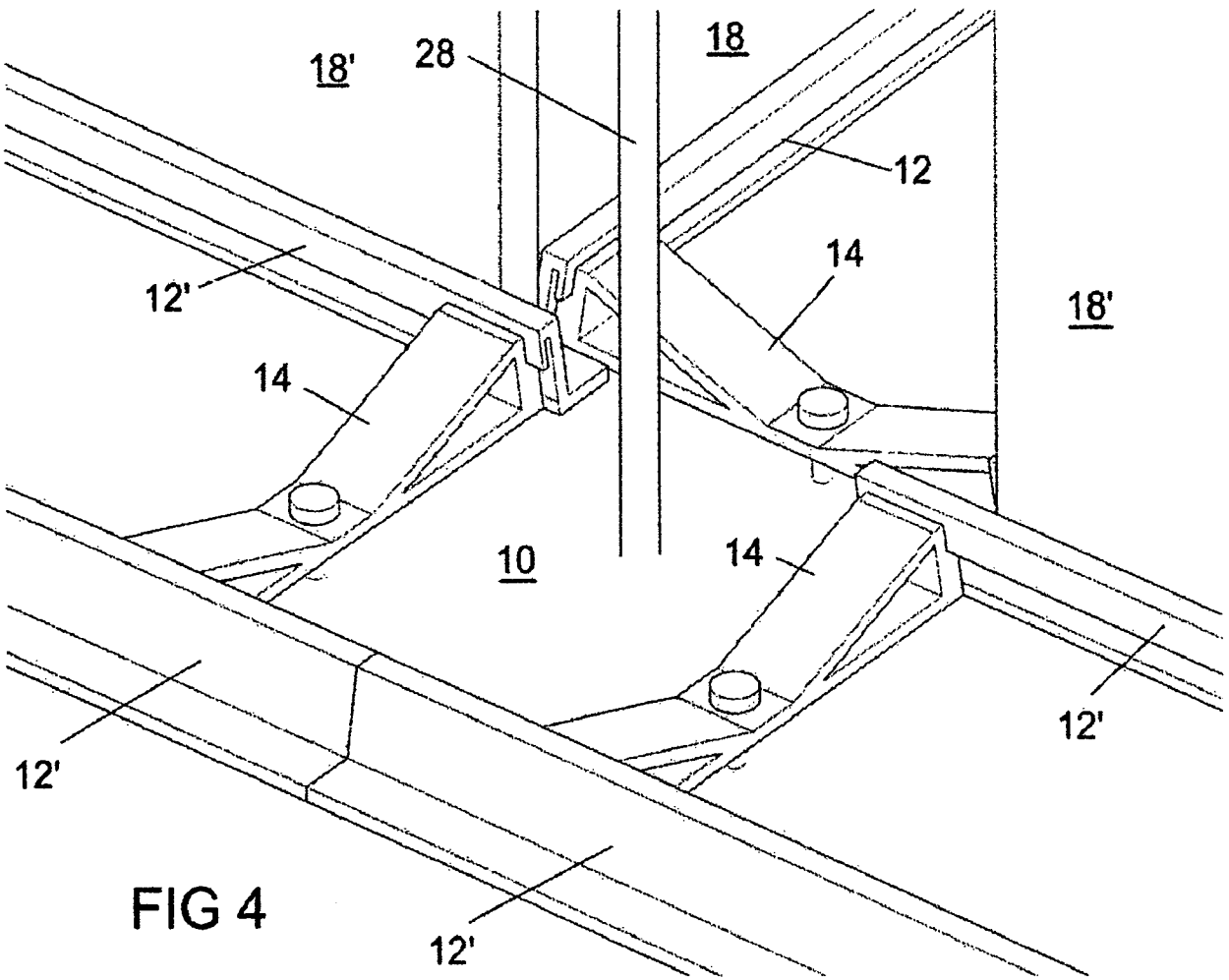
FIG. 4 is a perspective view of the apparatus of FIG. 1 with further rails and spacers to form a T-shaped join between walls.

Next, if the concrete floor 10 is uneven, any gaps between the rails 14 and the underlying floor 10 are sealed; following which concrete (not shown) is poured into the gap 30 between the formwork panels 18 to complete the wall. The ends of the gap 30 are closed off either by extending the rails and formwork up to an existing transverse wall, or by forming a T-join between walls as shown in FIG. 4. In FIG. 4, further rails 12' have been laid at right angles to the rails 14, and further panels 18' at right angles to the panels 18, to define a T-join between walls (the panels engaging the near rails 12' are omitted for clarity).

If necessary, for long walls two or more rails 12 may be laid end-to-end. Furthermore, different length spacers 14 may be provided for constructing different thickness walls. Although only two spacers 14 are shown in FIG. 1, the number of spacers used in any particular case, and their positioning along the rails, may be freely chosen according to requirements.

As well as enabling an engineer to accurately lay out where walls are to be placed and to effectively seal the bottom of the formwork before concrete is poured between the panels to ensure that there is no grout loss post pouring, barcodes (or other machine-readable identifiers) are also applied to the rails as they are produced and the rails are shipped with the associated permanent formwork panels which are also barcoded.

When a rail is scanned on site with a handheld scanner attached to a PDA on which a model of the building is either stored or accessible across a network, the PDA can display where the rail is to be fixed on the ground. Similarly before being placed in position, the formwork panel and rail can be scanned to ensure they are properly located and also to update the progress of the construction through the PDA. To further assist in this regard, an alignment line can be defined on the formwork panel, as well as on the or each rail, to allow for perfect alignment of the panel vis-à-vis the track.

Figure 5A:
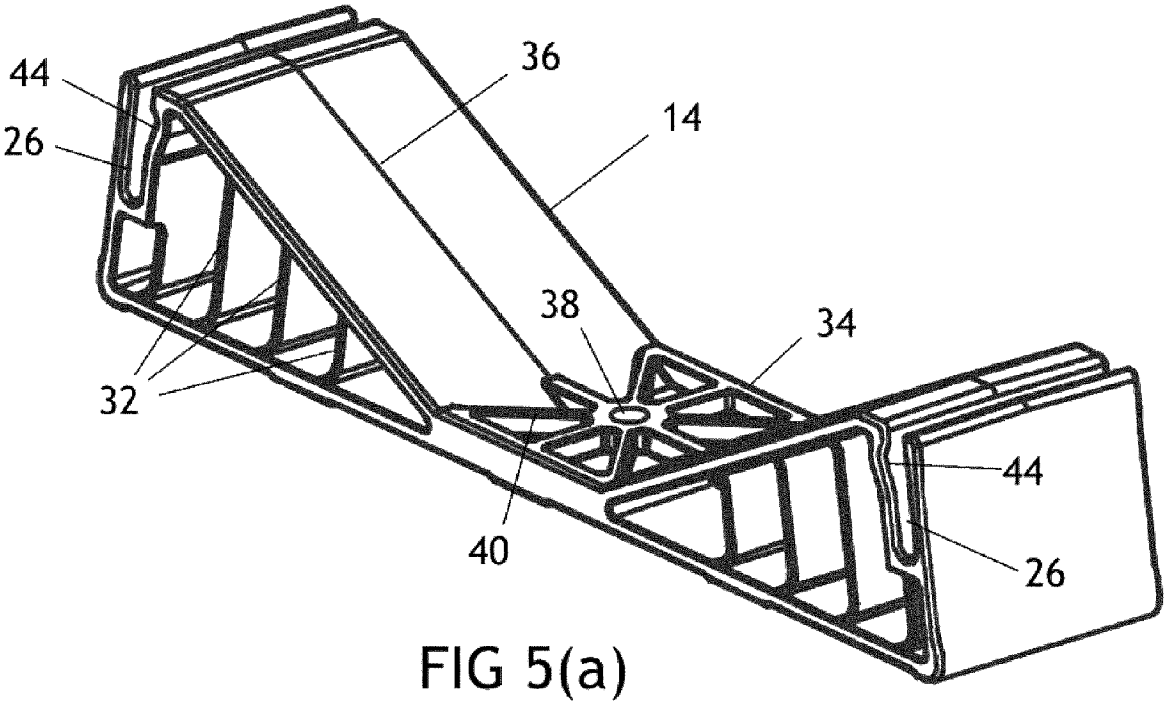
FIGS. 5*a* and 5*b* are perspective and cross-sectional side views respectively of a spacer used in a second embodiment of the invention.
Figure 5B:
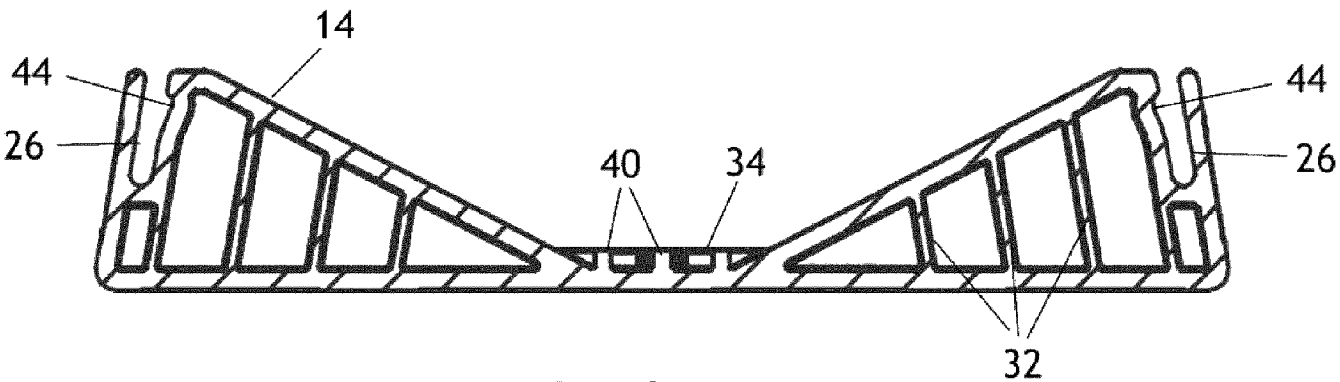
Figure 6B:
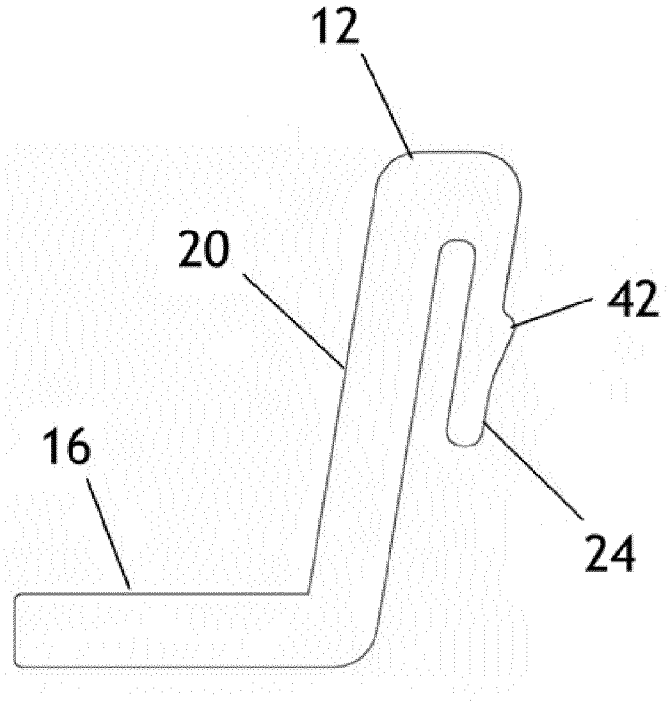
FIGS. 6*a* and 6*b* are perspective and cross-sectional views respectively of one end of a support rail for use with the spacer of FIG. 5 in the second embodiment of the invention.
Figure 6A:
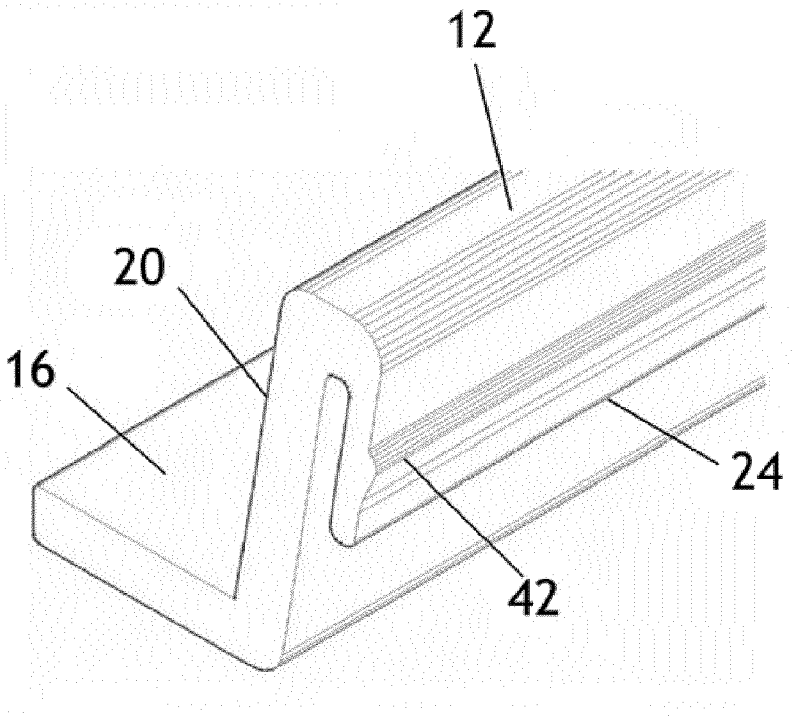
Figure 7:
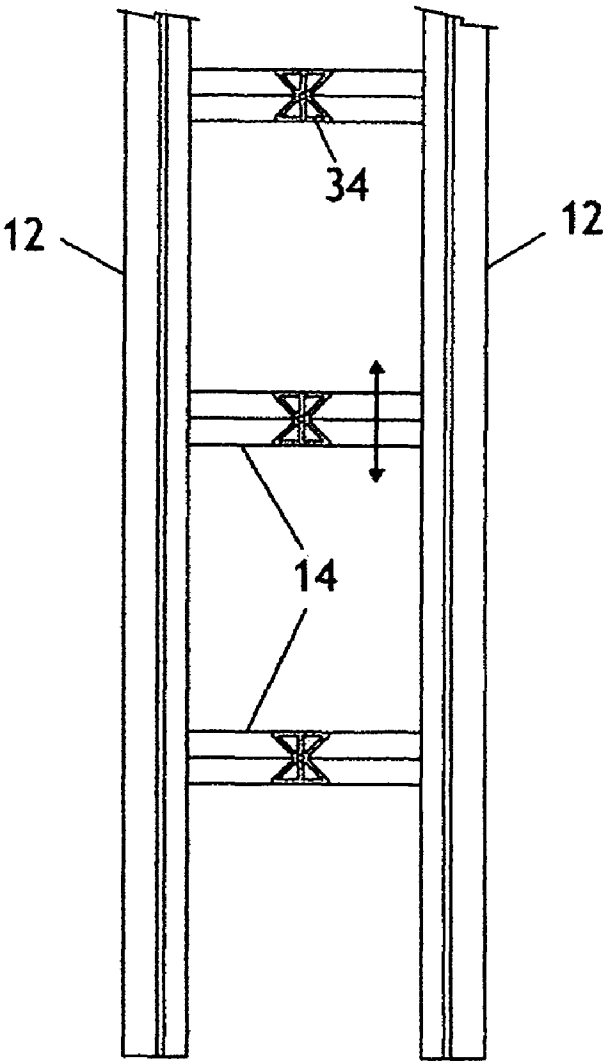
FIG. 7 is a plan view of the second embodiment of the invention.

FIGS. 5 and 6 show alternative forms of spacer and support rail for use in a second embodiment of the invention, shown in plan view in FIG. 7. Both the spacer and support rail are made of rigid PVC.

In this embodiment the spacer 14 retains the same overall "butterfly" shape as the spacer in the first embodiment. However, where the triangular "wings" of the butterfly are open in the first embodiment, here they are reinforced with three ribs 32 on each side of the center section 34 parallel to the respective end of the spacer, and by a vertical spine (not visible in the drawings) extending centrally within each wing normal to the ribs 32 (i.e., vertically below the mould mold line 36). In addition, the hole 38 in the center section 34 which receives the HILTI gun nail 22 (FIGS. 1 and 2) is reinforced by radial ribs 40 which resist cracking at fixing time.

The spacer and rails have cooperating detent means which resist removal of the spacer from the rails in a direction normal to the length of the rails, while still permitting sliding movement of the spacer along the rails. In particular, in this embodiment the detent means comprises a longitudinally extending rib 42 on the flange and a corresponding longitudinally extending depression 44 inside the slot, the rib 42 becoming located in and sliding along the depression 44 when the spacer slidably engages the rails.

The advantage of the detent is that a pair of rails can be snap fitted to opposite ends of a set of spacers in a factory to produce a self-supporting ladder-like arrangement, FIG. 7, which can be transported to a building site as a single self-supporting unit rather than transporting the parts separately as a kit with attendant risk of loss. If desired, the spacers in the self-supporting ladder assembly could be pre-loaded with HILTI gun nails, so that when the assembly is located on site, an operator can simply walk along the assembly and fix it in place.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A method of constructing a substantially vertical wall in situ on a solid floor, the method comprising:

laying at least one pair of rails on the solid floor with at least one spacer fixed to the floor engaging the rails and maintaining the rails substantially parallel to one another, the rails being separated by a narrow elongated gap whose width corresponds to a desired thickness of the wall, locating a pair of substantially parallel vertical formwork panels on the rails, each panel being supported by a lower edge on a respective rail, the formwork panels extending upwards to a height substantially greater than their separation so as to define a narrow vertical gap between them, and filling the gap between the formwork panels to form a vertical wall permanently fixed to the floor along its lower edge, the formwork panels remaining to form a permanent part of the wall, the spacer being positioned at different positions longitudinally of the rails.

2. The method of claim 1, comprising assembling the rails and a plurality of spacers in a self-supporting ladder-like arrangement prior to fixing the spacers to the floor.

3. The method of claim 1, wherein the spacer slidably engages the rails for positional adjustment longitudinally thereof.

4. The method of claim 3, wherein the spacer and rails have cooperating detents which resist removal of the spacer from the rails in a direction normal to the length of the rails, while permitting the sliding movement of the spacer along the rails.

5. The method of claim 4, wherein the spacer has opposite outer ends each having an upwardly opening slot for receiving a downwardly extending flange on a respective rail.

6. The method of claim 5, wherein the detents comprises a longitudinally extending rib on one of the slot and flange and a corresponding longitudinally extending depression on the other of the slot and flange, the rib being located in the depression when the spacer slidably engages the rails.

7. The method of claim 6, wherein each rail comprises a substantially flat elongated support plate for supporting the lower edge of a respective formwork panel and an inwardly inclined wall extending upwardly from the inside longitudinal edge of the support plate.

8. The method of claim 7, wherein the flange extends downwardly from the top of the inclined wall on the opposite side to the support plate.

9. The method of claim 1, wherein the rails are plastic extrusions having a substantially constant cross-section.

* * * * *